US008511941B2

(12) United States Patent
Curic et al.

(10) Patent No.: US 8,511,941 B2
(45) Date of Patent: Aug. 20, 2013

(54) DEVICE AND METHOD FOR DRILLING AND COMPACTING GROUND

(75) Inventors: Jasmin Curic, San Mauro Pascoli (IT); Paolo Cavalcoli, Ravenna (IT); Ezio Biserna, Longiano (IT)

(73) Assignee: Soilmec S.p.A., Cesena (IT)

( * ) Notice: Subject to any disclaimer, the term of this patent is extended or adjusted under 35 U.S.C. 154(b) by 86 days.

(21) Appl. No.: 13/160,224

(22) Filed: Jun. 14, 2011

(65) Prior Publication Data

US 2011/0305527 A1 Dec. 15, 2011

(30) Foreign Application Priority Data

Jun. 14, 2010 (IT) ..... TO2010A0507

(51) Int. Cl.
*E02D 3/046* (2006.01)

(52) U.S. Cl.
USPC ..... 405/271; 405/232; 405/233; 405/253; 175/325.3; 175/19

(58) Field of Classification Search
USPC ..... 405/271, 231, 232, 237, 238, 249, 405/252.1, 253, 233, 236; 175/19, 323, 325.3
See application file for complete search history.

(56) References Cited

U.S. PATENT DOCUMENTS

| | | | | |
|---|---|---|---|---|
| 4,112,692 | A * | 9/1978 | Anderson et al. | 405/271 |
| 4,458,765 | A * | 7/1984 | Feklin et al. | 175/19 |
| 4,504,173 | A * | 3/1985 | Feklin | 405/241 |
| 5,722,498 | A * | 3/1998 | Van Impe et al. | 405/232 |
| 5,797,705 | A * | 8/1998 | Kellner | 405/271 |
| 6,033,152 | A | 3/2000 | Blum | |
| 6,478,512 | B2 | 11/2002 | Sherwood | |
| 2006/0013656 | A1 | 1/2006 | Blum | |

FOREIGN PATENT DOCUMENTS

| | | |
|---|---|---|
| EP | 0 228 138 | 7/1987 |
| EP | 0 235 105 | 9/1987 |
| EP | 0 664 373 | 7/1995 |
| EP | 1 146 173 | 10/2001 |
| EP | 1 402 146 | 5/2007 |
| WO | WO 95/12050 | 5/1995 |

OTHER PUBLICATIONS

Italian Search Report for Application No. IT TO20100507 mailed Apr. 4, 2011.

* cited by examiner

*Primary Examiner* — Frederick L Lagman
(74) *Attorney, Agent, or Firm* — Merchant & Gould P.C.

(57) ABSTRACT

A device (1) for drilling and tamping grounds is constituted by a tamping tip (1A) rigidly connected to a shaft (3) which constitutes the connection to the end part of a battery of rods moved by a drilling machine, which gives it movement in a vertical direction and a rotation around its longitudinal axis. The battery of rods is inserted into a covering tube (14). Between the tamping tip (1A) and the tube (14) a substantially cylindrical tamping element (9, 9*a*) is interposed, adapted to define a tamping diameter of the ground which forms the walls of the hole obtained by the device (1) at least equal to the diameter of the tube (14).

13 Claims, 5 Drawing Sheets

DEVICE AND METHOD FOR DRILLING AND COMPACTING GROUND

This application claims benefit of Serial No. TO 2010 A 000507, filed 14 Jun. 2010 in Italy and which application is incorporated herein by reference. To the extent appropriate, a claim of priority is made to the above disclosed application.

BACKGROUND

Subject of the invention is a device and method for drilling and making foundation pole piles with a ground-tamping technology, which permits the use of covering tubes for drilling polluted grounds.

A growing problem consists in making foundation piles in polluted grounds, generally in areas for industrial use.

The drilling and tamping technology, also known as "displacement", is particularly used in presence of polluted grounds, as it permits to minimize the remaining material, that is the material exiting from the excavation necessary for making the pile. The works are so realized with the maximum respect of the environment and permit a relevant reduction of the costs, thanks to the fact that it is not necessary to dispose of great quantities of polluted ground, which necessarily requires special and very expensive treatments.

According to the present art, various drilling and tamping devices are known.

Patent EP-0228138 describes a drilling device which performs a tamping of the ground in a radial direction with respect to the drilling axis by means of a conical shaft which is provided with an elongated propeller extending up to the tip.

Patent EP-0664373 instead describes a drilling device provided with a fuse-shaped roller, loosely mounted on an axis inclined with respect to the rods of the drilling battery, which thanks to the rotation of the rods rolls on the surface of the excavation by tamping the ground.

It is always more frequently necessary to realize said drilling operation in presence of aquifer, which cannot be put into communication (for example when only the surface of one of them is polluted). Other times instead it can occur to drill in particularly unstable regions of ground (covering grounds) in which stabilization problems are encountered of the walls of the hole after the passage of the tool. It is therefore necessary to realize said drilling operation with the aid of a covering tube, which inhibits the collapse of the excavation but most of all inhibits the reflow/remix of waters coming from adjacent aquifers. This entails that the regions of ground already interested by the drilling operation remain totally insulated from the region in which the excavation is made, which generally is situated at the end region of the drilling device.

It is also necessary that said covering tube can be uncoupled from the tamping tool anytime during the drilling operation. In some situations it is in fact required to make piles starting from a lower height with respect to the ground level. Without being able to leave in the hole the covering tube after drilling, it would be necessary to cast concrete for the entire depth reached and then subsequently destroy the excess portion. This would be a waste of time, resources and material—either to be supplied or to be disposed of—with a consequent increase of the production costs.

Furthermore, when in presence of hard grounds or when particularly difficult layers must be crossed, the tamping tool is not able to advance and so it must be substituted with a digging tool to remove material, for example an auger or a bucket. In order to make such substitution, the tool has to be extracted from the hole by leaving the covering tube at the reached height.

In some situations the required depth of excavation is greater than the length necessary for the covering tube. In these cases, once having reached the value corresponding to the length of the tube, the tool must be disengaged from the tube, leaving it in place, and then continue the drilling operation. In the lifting/casting phase the tool is required to couple with the tube once again, in order to extract it from the hole.

Drilling devices are known, which permit the use of a covering tube.

Patents EP-0235105 and EP-1402146 show percussion drilling devices in which a digging tip, connected with a battery of rods, is generally combined with a bottom-hole hammer, and is able to drag a covering tube.

Such devices advance in the ground by the combined action of the percussion and the rotation. The debris produced in the region of the tip must be evacuated, as otherwise the tool would not be able to advance and they are conveyed at the surface, through the gap between the covering tube and the inner rod, by means of a fluid, generally water, for the perforation. This fluid is brought up to the perforating tip through channels internal to the tool.

Both mentioned devices are provided with a cutting means positioned on the digging tip, which make a hole having a diameter sufficient to advance the covering tube in the ground. In order to be able to extract the battery of rods and the digging tip from the covering tube, the counterbore element must be able to take configuration in which its maximum encumbrance is smaller than the internal diameter of the tube. For this reason its shape is of the eccentric kind, so that it can take two main positions: the working one, corresponding to the maximum diameter, and the closing one, corresponding to the minimum diameter.

In the operative phase, said digging head so has the function of enlarging the hole created by the drilling tip preceding it. This enlargement is realized with a removal of material, which is removed/detached from the walls of the excavation by means of digging/disrupting accessories. These means are usually teeth or bits. The first ones literally dig the ground, whereas the second ones breaks it up thanks to the high pressure generated with the contact between the same and the bit.

In any case, when making a drilling operation with removal of material, it happens that the hole created has a greater diameter with respect to that of the tool which has made the drilling operation. The excavation and the subsequent removal of the ground produce a loosening of all surrounding material of the hole, and also thanks to the action of the drilling fluid injected from the central duct, they create such a crumbling that an excavated hole is obtained, having much greater dimensions than those of the tool itself.

It is therefore evident that a gap is generated between the covering tube and the walls of the excavation realized by the reamer element. It is consequently impossible to separate the high regions of the battery from those of the excavation. During the crossing of an aquifer, water would have access to all other ground layers which are placed above and below it, and which are involved in the drilling operation. The same drilling fluid can act as a contaminant means. Therefore this kind of devices cannot be used in polluted grounds.

Furthermore, the field of application of the preceding patents being of the known art is that of the drilling operation with a bottom-hole hammer, which involves the excavation in particularly hard and rocky grounds, which therefore are generally stable. The presence of the tube is uniquely reserved to the first meters of excavation in which generally what is in jargon called "covering ground" is present, characterized by an incoherent matrix which tends to close upon the hole itself.

When this matrix has gone through, the excavation reaches rocky grounds and the tip must be adequately dimensioned in order to dig a hole much greater than the tube, so that it can insist on the bedrock without running aground.

SUMMARY

Aim of the present invention is to realize a device for drilling and tamping grounds for making foundation piles, which solves the previously explained problems.

For reaching these and other aims which will be better comprised in the following, the invention proposes to realize a drilling device for making piles having a ground-tamping technology and to a method for executing such drilling operation.

BRIEF DESCRIPTION OF THE DRAWINGS

The equipment according to the invention will be now described, in three embodiments in any case non limitative, with reference to the annexed drawings, in which.

DETAILED DESCRIPTION

Figure 1:
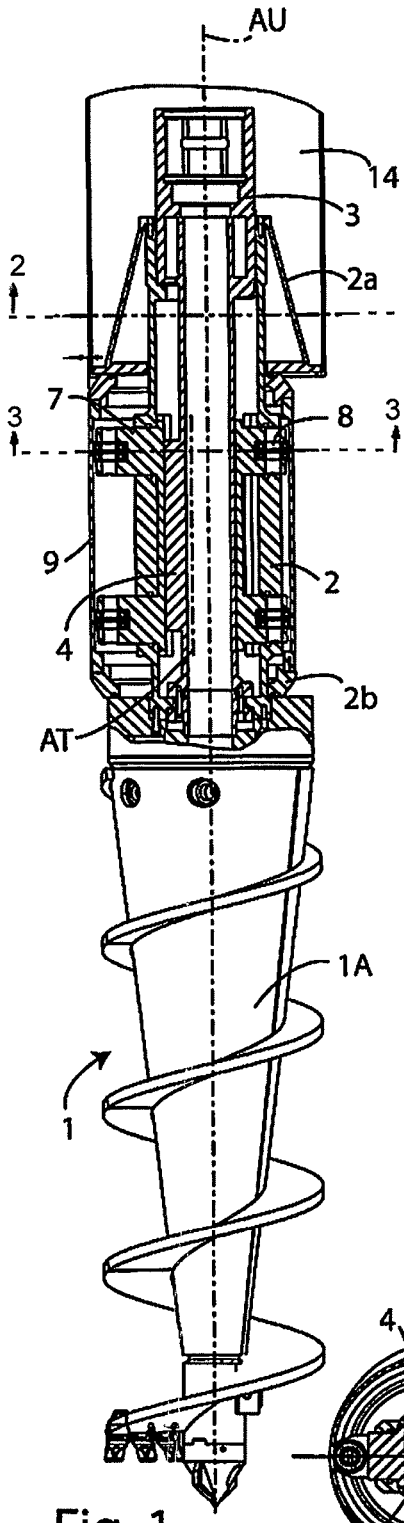
FIG. 1 is a longitudinal cross-section of a first embodiment of the device according to the invention, with the tamping roller in an open condition.
Figure 3:
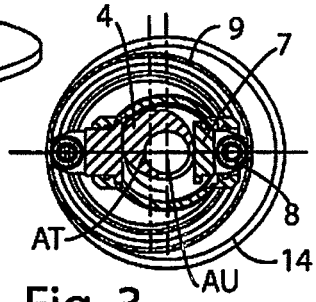
FIG. 3 is the cross-section of the device of FIG. 1 taken along line 3-3 of FIG. 1.
Figure 5:
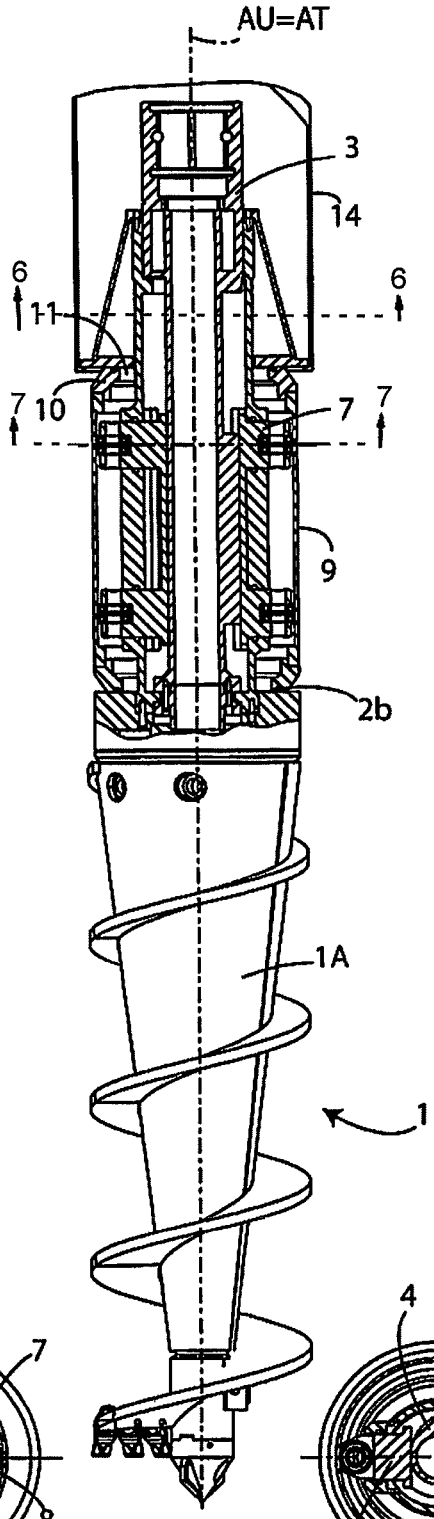
FIG. 5 is the longitudinal cross-section of the device according to the invention as in FIG. 1 but with the tamping roller in a closed condition.
Figure 7:
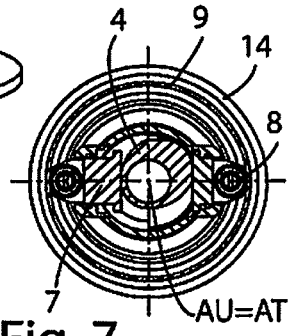
FIG. 7 is the cross-section of the device of FIG. 5 taken along line 7-7 of FIG. 5.
Figure 2:
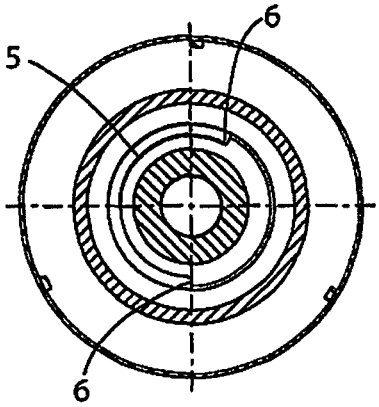
FIG. 2 is the cross-section of the device of FIG. 1 taken along line 2-2 of FIG. 1.

With reference to the first embodiment shown in FIGS. 1-8 drilling device 1 is made by a tamping tip 1A rigidly connected to a main support 2 which contains at its top an inverted truncated conical element 2*a* which in turn is connected to a shaft 3 which makes the connection with the end part of a battery of rods (not shown).

Said battery of rods is moved by a drilling machine, which exerts on it a movement in a vertical direction (by pulling/pushing) and a rotation (torque). The device is further provided with a tamping roller 9 provided for enlarging the hole in the ground, so permitting the advancement of covering tube 14. It is further provided with a blocking system 12,13,14 (FIGS. 4 and 8) adapted for driving covering tube 14 into the hole in the ground, or to uncouple it from tool 1.

The connection between main support 2 and shaft 3 is not rigid. They can make a mutual rotation of limited entity, defined by two limit positions, made by the interference of ridge 5 integral with main support 2, with the two matching points 6, integral with shaft 3.

Main support 2 has prismatic guides in which pushers 7 are forced to slide radially. Said pushers 7 are further in contact with shaft 3, precisely at the region having eccentric profile 4. During said mutual rotation main support 2 drives pushers 7. Under the pushing action of the eccentric profile acting as a cam, they make a movement in a radial direction. Pushers 7 are provided with rollers 8 which are in a direct contact with tamping roller 9. By moving laterally, two rollers 8 force tamping roller 9 to move from a position coaxial with the battery to an offset position. Tamping roller 9 is mounted idle on rollers 8 in order to maintain the frictions limited and realize the tamping of the ground, so minimizing the requests of torque at the machine tool.

In particular, with reference to FIGS. 1-4, during the descent and tamping phase the drilling machine exerts on the battery of rods a clockwise rotation. Tamping tip 1*a* advances into the ground, so creating a hole having a diameter equal to the maximum one of the tip.

Thanks to its rotation, once ridge 5 has come in contact with one of the two matching points 6, shaft 3 drives in rotation main support 2. Rollers 8 act on the internal portion of tamping roller 9, by keeping it in a position in which its axis AT is offset with respect to axis AU of tool 1. The clockwise rotation of the rods forces tamping roller 9 to place or maintain itself in an eccentric configuration.

Axis AT of tamping roller 9, which is defined by the position of pushers 7, is forced to rotate together with the whole tamping tool 1, under the action of the battery of rods, around axis AU. During this movement tamping roller 9 comes in contact, on its external part, with the surrounding ground. The friction generated makes tamping roller to begin to rotate, rolling on rollers 8, around its own axis AT.

Ultimately, tamping roller 9 makes a movement which is the composition of the two preceding movements, that is the rolling on the walls of hole 18. This movement generates a lower friction component which will require that the drilling tooling exert a lower torque for advancing during the tamping.

Figure 4:
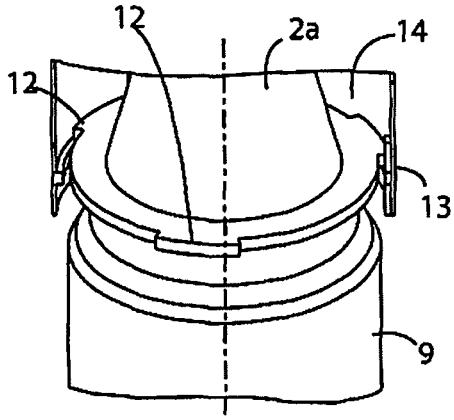
FIG. 4 is the three-dimensional view of the coupling system of the covering tube of the device in a coupling condition.
Figure 6:
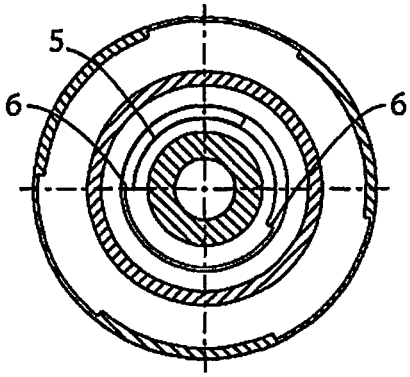
FIG. 6 is the cross-section of the device of FIG. 5 according to the plan D-D taken along line 6-6 of FIG. 5.
Figure 8:
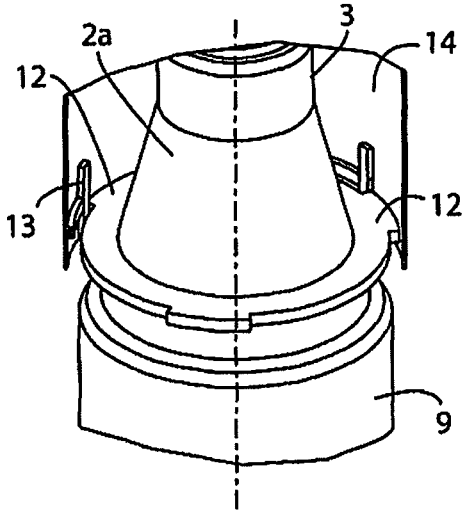
FIG. 8 is the three-dimensional view of the coupling system of the covering tube of the device in an uncoupling condition.

At the same time, covering tube 14 is driven by main support 2 through a joint realized by the contact between ridges 12 which come in connection with relative connections 13 of covering tube 14 (see FIG. 4).

Tamping roller 9, which is in its working/open configuration, rolls and pushes/compresses the ground by forcing hole 18 to take a diameter equal to that of rolling. As can be seen from FIG. 3, this rolling diameter is exactly equal to the external one of covering tube 14. In this way a hole is generated which has the precise dimensions of covering tube 14.

Differently from the teeth and the bits, the tamping roller does not remove the ground. The walls of the excavation take a smooth and uniform appearance which permits to precisely adhere to the covering tube.

The ground is tamped and forced by the tamping roller to take a certain diameter and once the drilling/stabilizing part of the tool has passed, it always shows a phenomenon of relaxation. That is, the ground tends to "elastically" return to a less compressed configuration and the walls of the excavation move against the tube. This phenomenon, typical only of the grounds which can be displaced/tamped (and not of those for which other drilling techniques are used), further facilitates the adhesion of the ground to the external surface of the covering tube. In this way no empty spaces remain between hole and pipe. Therefore no possible passages for the water are created, which would tend to ascend along the excavation.

In an axial direction, tamping roller 9 is kept in place by matching dedicated areas 10 which come in contact with respective grooves 11 obtained in main support 2. These contact areas are further provided with suitable sealing 2*b* which avoid the reflux of a liquid inside the covering tube.

With reference to FIGS. 5-8, tool 1 is represented in its configuration of a minimum diameter. Starting from the previously shown configuration, the battery of rods is rotated in a anticlockwise direction. The surrounding ground, thanks to the friction, tends to retain tamping device 1A. Then a relative counter-rotation occurs between shaft 3 and main support 2 which is integral with tamping device 1A. Eccentric 4 withdraws pushers 7 and permits to tamping roller 9 to realign itself with axis AU, by taking once again a minimum diameter which is lower than the internal diameter of covering tube 14. The anticlockwise-rotation of the rods so forces tamping roller 9 to be placed and/or kept in a configuration of minimum encumbrance, centered and aligned with drilling device 1. The same counter-rotation disengages covering tube 14 from main support 2 (see FIG. 8).

From this point onwards it is possible to extract tool 1 from the hole passing through covering tube 14 which remains in place in the ground.

Once having tool 1 been separated from covering tube 14, it is also possible to continue the drilling operation by leaving the tube at the reached height. In the subsequent phase of ascent it will be possible to couple the tube again and proceed with its extraction, or allow it to work and remove the tool from the hole. In order to complete the construction of the foundation element, during the ascent phase the hole is filled with a cast concrete. Said concrete is pumped from the inside of the battery of rods and is left to come out of an aperture placed on the tip of the tamping device.

In all these cases the opening/closing operations of tamping roller 9 and the coupling/uncoupling of covering tube 14 are respectively obtained by rotations of the battery of rods, in a clockwise and anticlockwise direction, respectively.

Figure 9:
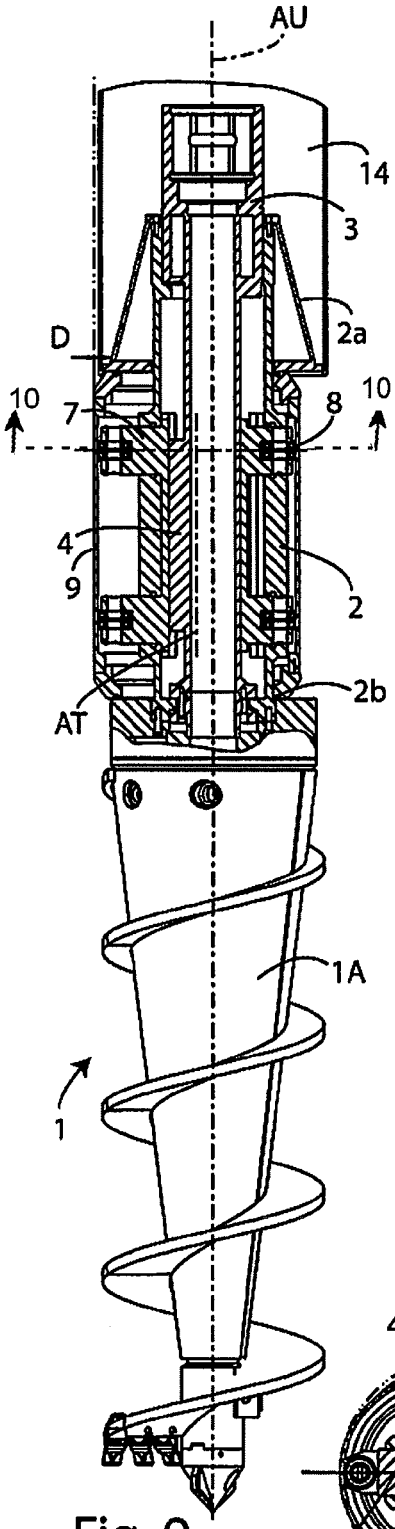
FIG. 9 is the longitudinal cross-section in a second embodiment of the device according to the invention with the tamping roller in an open condition.
Figure 10:
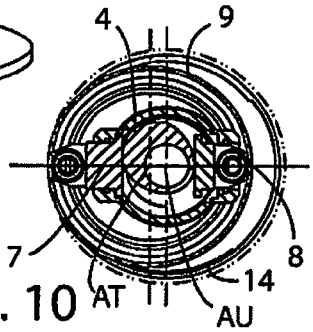
FIG. 10 is the cross-section of the device of FIG. 9 according to the plan F-F taken along line 10-10 of FIG. 9.

In FIGS. 9-10 a second variant of the drilling device is shown. In this version the tamping roller produces an enlargement of the hole up to a diameter greater than that of the covering tube (portion D in FIG. 9). This version is used when the ground to be drilled is characterized by a strong slackening, once the tamping device has gone through. In this case the ground which tends to close the hole again would exert on the covering tube a very high pressure. The great frictions would greatly increase the torque required from the machine tool in order to put in rotation the battery of rods, integral with the covering tube.

It is evident that more versions of the tamping roller can be realized, by varying its diameter in order to adjust from time to time the drilling tool to the kind of ground to be tamped.

Figure 11:
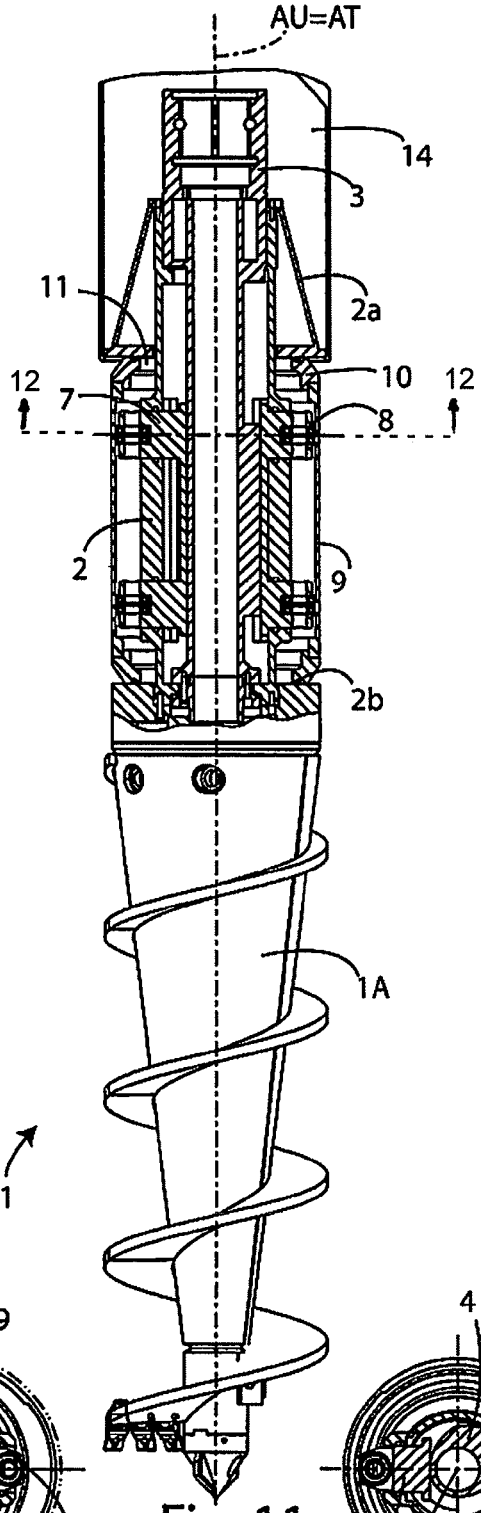
FIG. 11 is the cross-section of the device according to the invention as in FIG. 9 but with the tamping roller in a closed condition.
Figure 12:
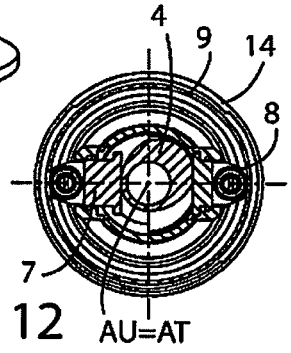
FIG. 12 is the cross-section of the device of FIG. 9 according to the plan G-G taken along line 12-12 of FIG. 11.

In FIGS. 11-12 the same drilling device of the FIGS. 9-10 is shown in a configuration with a minimum diameter, with the tamping roller aligned with the drilling axis.

Figure 13:
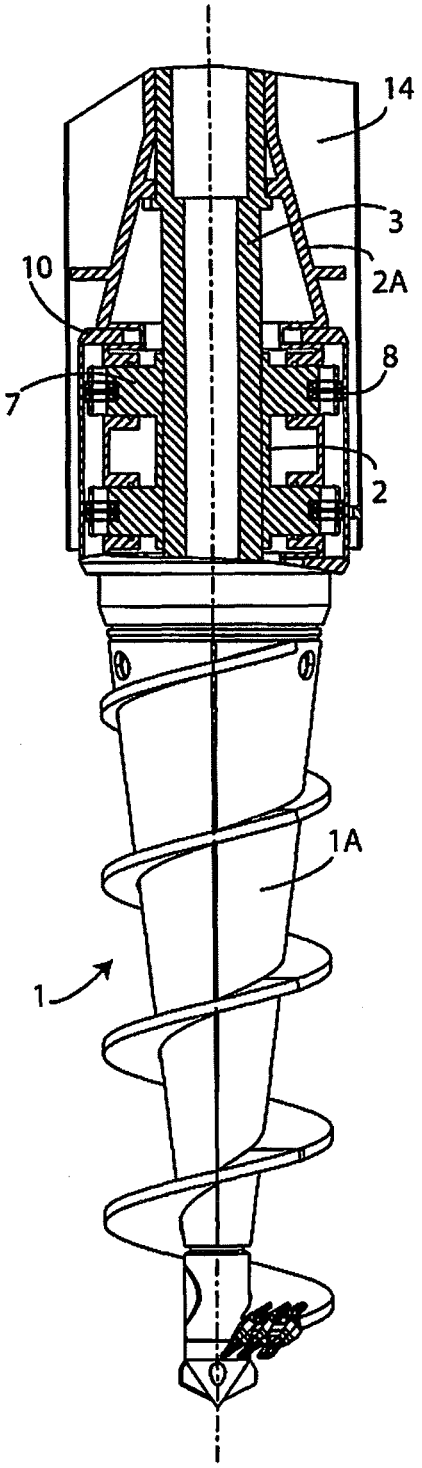
FIG. 13 is the longitudinal cross-section of the device of FIG. 9 with the battery of rods, the tamping device and the tamping roller which are removed, at lifting, from the covering tube.

In FIG. 13 tool 1 of FIG. 9 is represented inside covering tube 14 in a possible phase of ascent in which the tube is left running, or it is recovered in subsequent phases.

Figure 14:
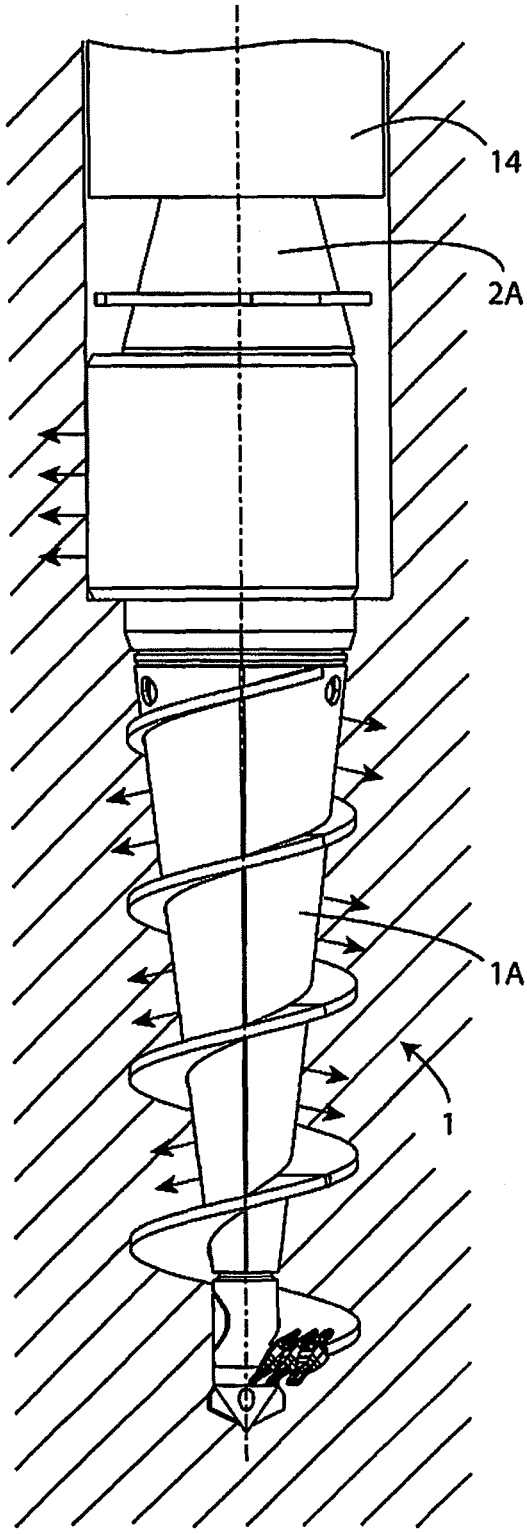
FIG. 14 is the side view of the device of FIG. 9 which shows the excavation diameters of the various parts.

In FIG. 14 drilling tool 1 is represented advancing with respect to covering tube 14, in order to make the drilling operation at a lower height than that of the tube.

Figure 15:
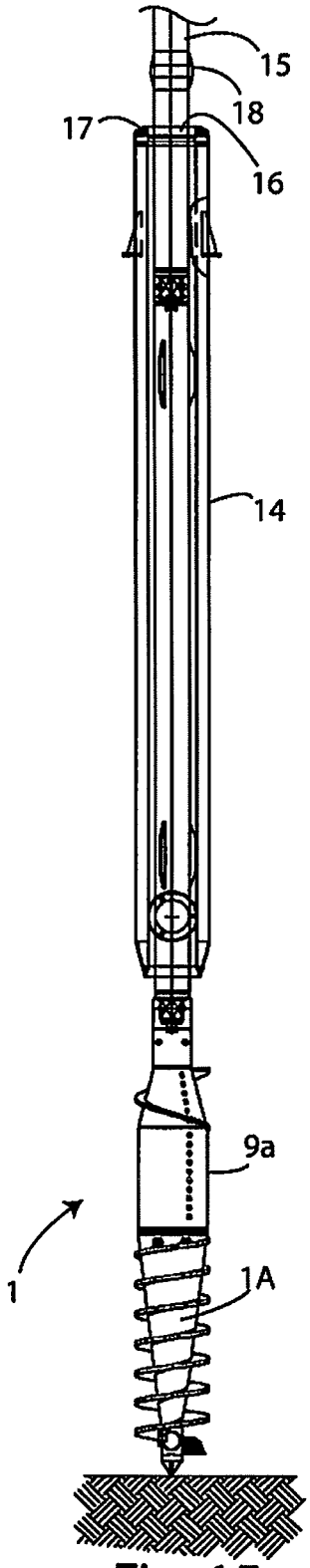
FIG. 15 is the side view of a third simplified embodiment of the device.
Figure 16:
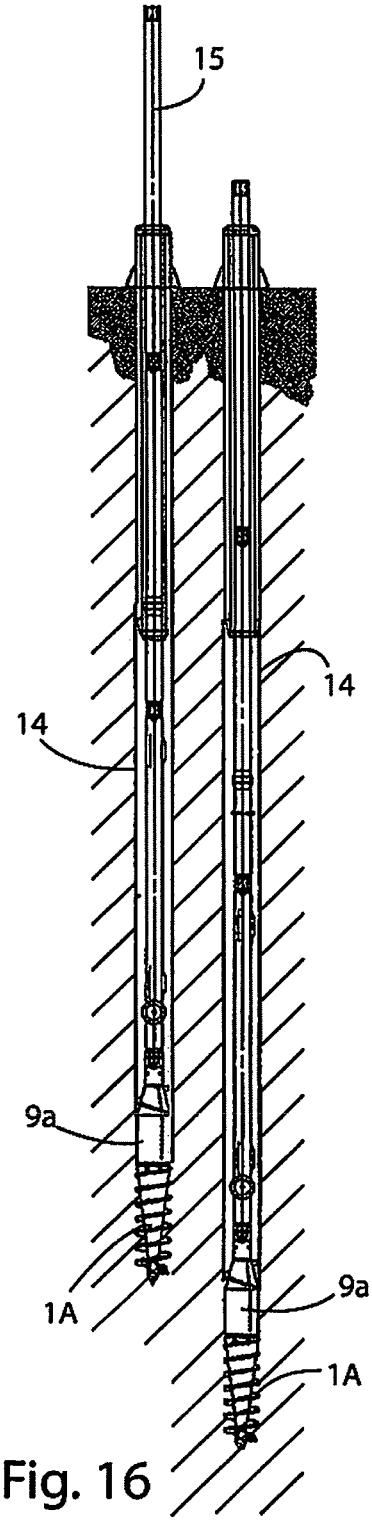
FIG. 16 shows on the left the side view of the device of FIG. 15 with the tube completely driven into the ground and on the right the side view of the device of FIG. 15 with the drilling device advancing with respect to the covering tube.

In FIGS. 15 and 16 a further variant of the device is illustrated, which can be used when the polluted layers are located at the surface.

This version is greatly simplified with respect to the previous ones. The tamping device makes a hole having a diameter equal or greater than that of covering tube 14, without the aid of an enlarging tamping roller, as the tamping function will be made from cylindrical portion 9*a* having a diameter equal or slightly greater than that of tube 14. In this way the drilling operation is performed, so that the entire cross-section of the hole always remains occupied with the tamping device. Therefore no free space areas are present, which are created around the tamping roller of the previous versions due to its eccentric position. So this version guarantees a maximum degree of tightness.

First rod 15 of the battery is provided with fins 16 which, by engaging at matching points 17, drive covering tube 14 into the ground, by transmitting a pull/push action and torque to it. Once tube 14 has been totally driven into the ground (see FIG. 16 on the left) the joint is freed between the first rod and the covering tube with a simple counter-rotation of the battery. It is then possible to continue the drilling operation up to the desired height, leaving covering tube 14 still (see FIG. 16 on the right). Matching points 18 permit to keep the battery of rods centered in the covering tube once they penetrate inside the tube.

In the phase of ascent, not being it possible to pass through the tube, it will be recovered from the battery of rods and extracted at the same time with it. The danger of pollution is cancelled due to the fact that the hole is filled with concrete at the same time of the extraction of the tube.

The operations of coupling the covering tube are simplified, as the joint region is proximate to the ground level and so it is easily visible by the operator.

On the contrary, this version of the device does not permit to leave the tube in place and only extract the tool. As a consequence, the covering tube cannot be coupled and it will have a fixed length at the beginning of the drilling operation.

The invention described permits to make foundation piles with a tamping technology in combination with a covering tube. So it can be used in presence of an aquifer, of inconsistent and polluted grounds, by greatly increasing their flexibility in use and guaranteeing that the healthy grounds are not contaminated by the polluted grounds.

It is further possible to make tamping piles starting from a height lower than the ground level. To this end, it is sufficient to interrupt the cast concrete in the excavation at the desired depth, before the ground level, by knowing that the walls of the excavation cannot collapse thanks to the presence of the covering tube.

The same covering tube is not provided with digging elements, but it is purely driven up to the depth required by the central battery of rods. So it can also be left in place as an armature of the pile.

The drilling is made possible in hard and difficult layers with the same battery, as the substitution of the tamping tool with tools with a material removal is rapid.

The "idle" tamping roller permits to obtain the maximum diameter of excavation through a modelling or "rolling" of the ground. This makes that no sliding is generated between the ground of the walls of the excavation and the tamping roller, so minimizing the frictions. This greatly reduces the requests of power from the machine tool, lowering its consumptions and facilitating the drilling operation, which can be realized with machine tools of smaller size. The wear of the parts is reduced, extending the tool's life and reducing the maintenance costs.

The invention claimed is:

1. Device for drilling and tamping grounds comprising a tamping tool comprising a tip rigidly connected to a shaft which comprises the connection to an ending part of a battery of rods moved by a drilling machine, which gives the device movement in a vertical direction and a rotation around a longitudinal axis; the battery of rods being inserted into a covering tube; wherein a substantially cylindrical tamping element is interposed between the tamping tip and the tube for defining a tamping diameter of the ground which forms walls of a hole obtained by the device at least equal to the diameter of the tube;

wherein the tube is adapted to be axially uncoupled from said tool and from said tamping element.

2. The device according to claim 1, wherein the tube is disengageably constrained to a support upon which said tamping element is fitted, which is movable on the support between a closed position wherein the tube is concentric with respect to the shaft and can slide alternatively internally or away in depth from the tube, when the tube is disengaged from the support, and an open position wherein the tube eccentrically rotates around the axis of the shaft defining a circular surface of tamping of the walls of the hole obtained by the device having a diameter at least equal to the diameter of the tube.

3. The device according to claim 1, wherein the tamping element defines, in operating condition, a circular surface of tamping of the walls of the hole obtained by the tamping tool having a diameter greater than the diameter of the tube.

4. The device according to claim 3, wherein the diameter of the tamping element varies as a function of the type of the ground wherein the device operates.

5. The device according to claim 1, wherein the tamping element is mounted on rollers of pushers forcedly sliding in radial direction on prismatic guides of a support; the pushers are positioned in contact with a cam portion of the shaft which determines the radial displacement such that the rotation axis of the tamping element is alternatively coincident with a rotation axis of the shaft, in said rest position, and parallel but not coincident with the rotation axis of the shaft in said operating condition.

6. The device according to claim 5, wherein the support and the shaft are respectively provided with ridges and matching points which permit an angularly limited reciprocal rotation of said elements and when the ridges and matching points enter in contact, the ridges and matching points make the support integral in rotation with the shaft activating the cam-pushers-rollers group for positioning the tamping element eccentrically with respect to the axis of the shaft.

7. The device according to claim 1, wherein the tamping element is fixed with respect to other parts comprising the tamping tool and coaxial to the other parts comprising the tamping tool, inserted under the tube and has a diameter substantially equal to the diameter of the tube.

8. The device according to claim 7, wherein the covering tube is disengageably rotatably constrained to a support through joints comprising ridges of one of the covering tube or the support which couple with relative couplings to the other of the covering tube or the support.

9. Drilling and tamping method of grounds using a device according claim 1, wherein the method comprises the following steps:

a) positioning the tamping device in the ground with dragging of the covering tube at least for part of the excavation;

b) without disengaging the tube, extraction of the battery of rods from the hole with contemporary pumping of concrete inside the battery of rods.

10. A method according to claim 9, wherein in the step b) the final height of the concrete casting stops before ground level.

11. Drilling and tamping method of grounds using a device according claim 1, wherein the method comprises the following steps:

a) positioning the tamping device in the ground with dragging of the covering tube at least for part of the excavation;

b1) disengaging of the tamping tool from the tube;

b2) closing of the tamping element in a condition wherein the tamping element is concentric with respect to the tube and has a section with diameter smaller than the a diameter the tube;

b3) extraction of the battery of rods leaving the tube in function with the contemporary pumping of concrete inside the battery of rods.

12. Drilling and tamping method of grounds using a device according claim 1, wherein the method comprises the following steps:

a) positioning the tamping device in the ground with dragging of the covering tube at least for part of the excavation;

b1) disengaging of the tamping tool from the tube;

b2) continuing with the drilling with the tamping device up to the designed height, leaving the tube to the intermediate desired height;

b3) extraction of the battery of rods leaving the tube in function with the contemporary pumping of concrete inside the battery of rods.

13. Drilling and tamping method of grounds using a device according claim 1, wherein the method comprises the following steps:

a) positioning the tamping device in the ground with dragging of the covering tube at least for part of the excavation;

b1) disengaging of the tamping tool from the tube;

b2) continuing with the drilling with the tamping device up to the designed height, leaving the tube to the intermediate desired height;

b3) extraction of the battery of rods with the contemporary pumping of concrete inside the battery of rods itself up to the coupling height of the tube, rotation of the tamping device for engaging the tube, contemporary extraction of the rod and of the tube with contemporary continuation of the casting.

* * * * *